US008167532B2

(12) United States Patent
Hsu et al.

(10) Patent No.: US 8,167,532 B2
(45) Date of Patent: May 1, 2012

(54) COWLING

(75) Inventors: Wei-Chun Hsu, Taoyuan Hsien (TW); Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 548 days.

(21) Appl. No.: 11/699,959

(22) Filed: Jan. 31, 2007

(65) Prior Publication Data

US 2007/0248449 A1 Oct. 25, 2007

(30) Foreign Application Priority Data

Apr. 21, 2006 (TW) ..... 95114254 A

(51) Int. Cl.
*F03D 7/00* (2006.01)

(52) U.S. Cl. ..... 415/4.2; 415/907

(58) Field of Classification Search ..... 415/4.2, 415/4.4, 907, 4.1, 4.3, 4.5; 290/44; 416/196 A
See application file for complete search history.

(56) References Cited

U.S. PATENT DOCUMENTS

| | | | | |
|---|---|---|---|---|
| 171,962 | A * | 1/1876 | Stephens et al. | 415/4.1 |
| 1,677,745 | A * | 7/1928 | Bonetto | 415/232 |
| 4,142,822 | A * | 3/1979 | Herbert et al. | 415/53.1 |
| 4,174,923 | A * | 11/1979 | Williamson | 415/211.1 |
| 4,260,325 | A * | 4/1981 | Cymara | 415/4.4 |
| 4,295,783 | A * | 10/1981 | Lebost | 415/4.4 |

* cited by examiner

*Primary Examiner* — Edward Look
*Assistant Examiner* — Dwayne J White
(74) *Attorney, Agent, or Firm* — Birch, Stewart, Kolasch & Birch, LLP

(57) ABSTRACT

A cowling of the invention includes a cover body and an empennage connected with the cover body. The cover body includes an accommodating space for receiving an impeller, and a first opening serving as an air inlet for the impeller. According to the wind direction, the empennage will adjust the first opening to the proper position to face the wind.

12 Claims, 11 Drawing Sheets

COWLING

BACKGROUND OF THE INVENTION

1. Field of the Invention

The invention relates to a cowling, and in particular, to a cowling for a wind power generator.

2. Description of the Related Art

An impeller of a conventional wind power generator is driven by wind to generate electric power. Wind, however, blows in all directions. If the wind does not blow directly on the impeller, the wind power generator can not operate at optimum efficiency. Another impeller of a conventional wind power generator changes direction corresponding to wind direction. When the turbulence occurs, the impeller loads wind force in all directions, the potential damage causes to the wind power generator.

The invention provides a cowling applicable to any kind of impeller for wind power generators, capable of effectively solving the described problems.

BRIEF SUMMARY OF INVENTION

The invention provides a cowling for a wind power generator. The cowling rotates to face the wind according to wind direction, avoiding impeller load due to multidirectional wind force thus protecting the impeller.

The cowling of the invention includes a cover body and an empennage connected with the cover body. The cover body includes an accommodating space for receiving an impeller, and a first opening serving as an air inlet for the impeller. According to the wind direction, the empennage will adjust the first opening to the proper position to face the wind.

If the wind is a multidirectional and turbulent, the cowling can be positioned to provide a single direction for channeling the multidirectional turbulence through the impeller from the first opening and drive to the impeller. The cover body blocks turbulence from entering the cowling from a direction interfering with the impeller. Thus, the impeller works efficiently and the lifespan of the impeller is prolonged.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope df the invention is best determined by reference to the appended claims.

Figure 1:
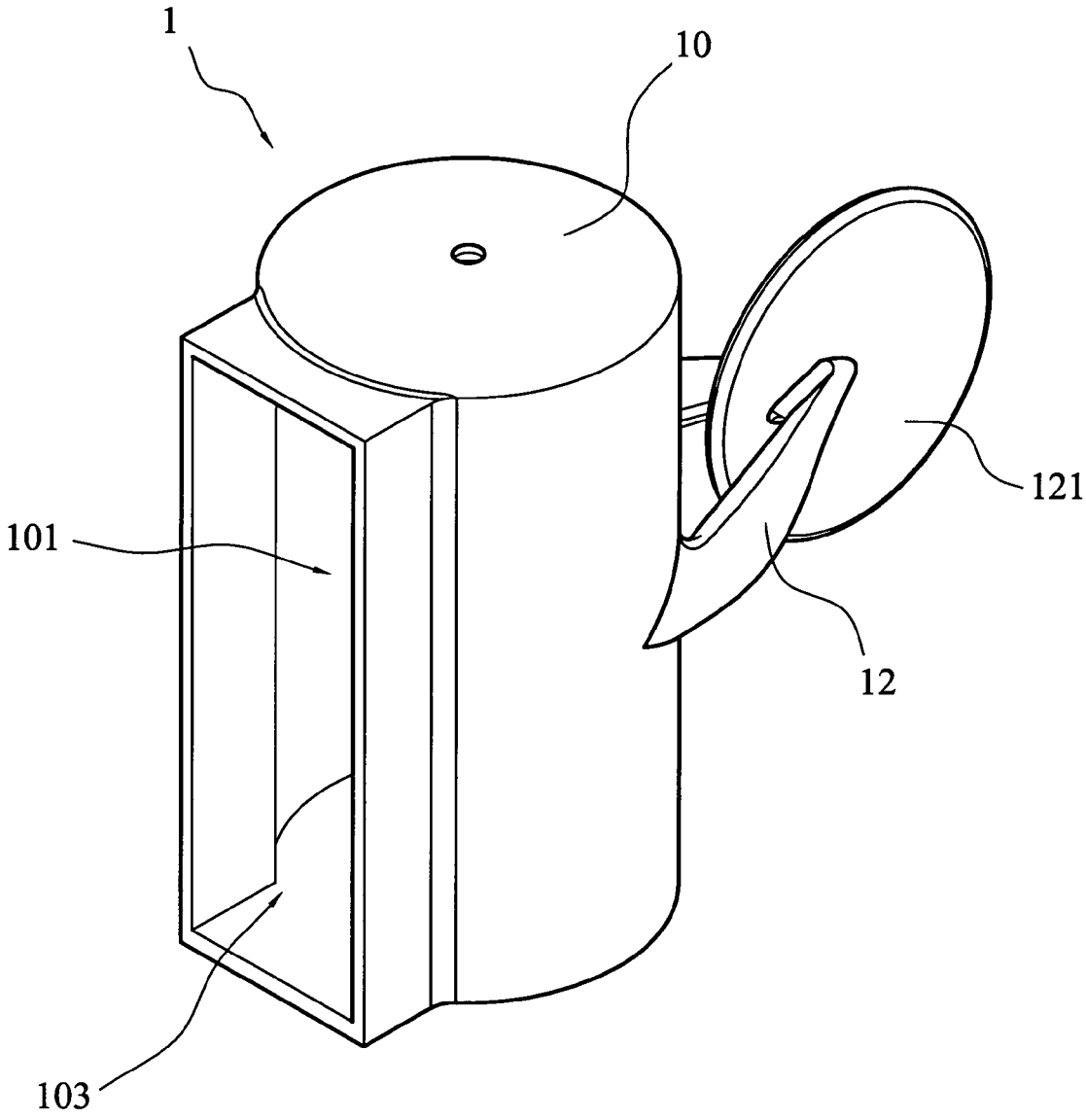
FIG. 1 shows an embodiment of a cowling of the invention.
Figure 2:
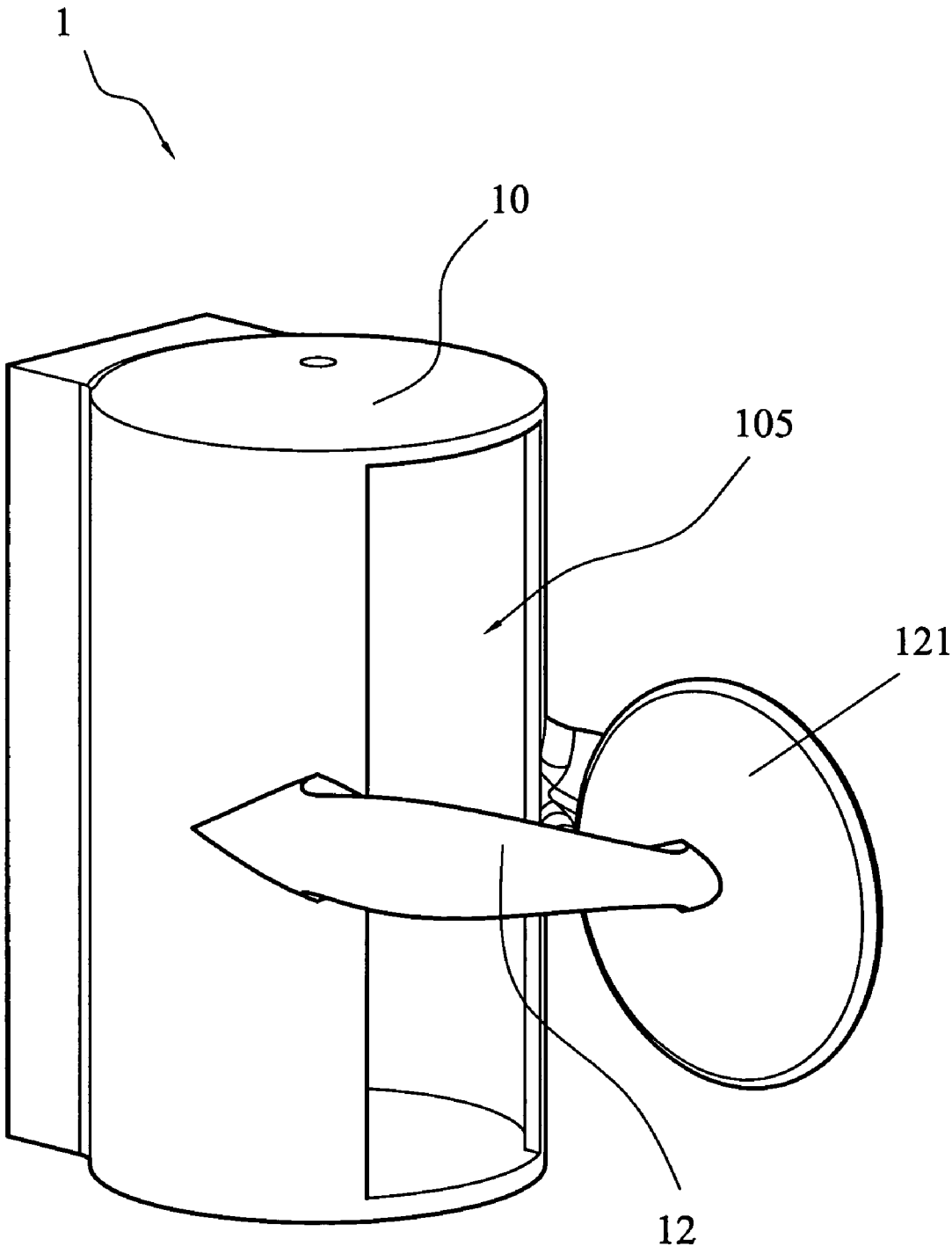
FIG. 2 is a schematic view in a different view angle of the cowling shown in FIG. 1.
Figure 3:
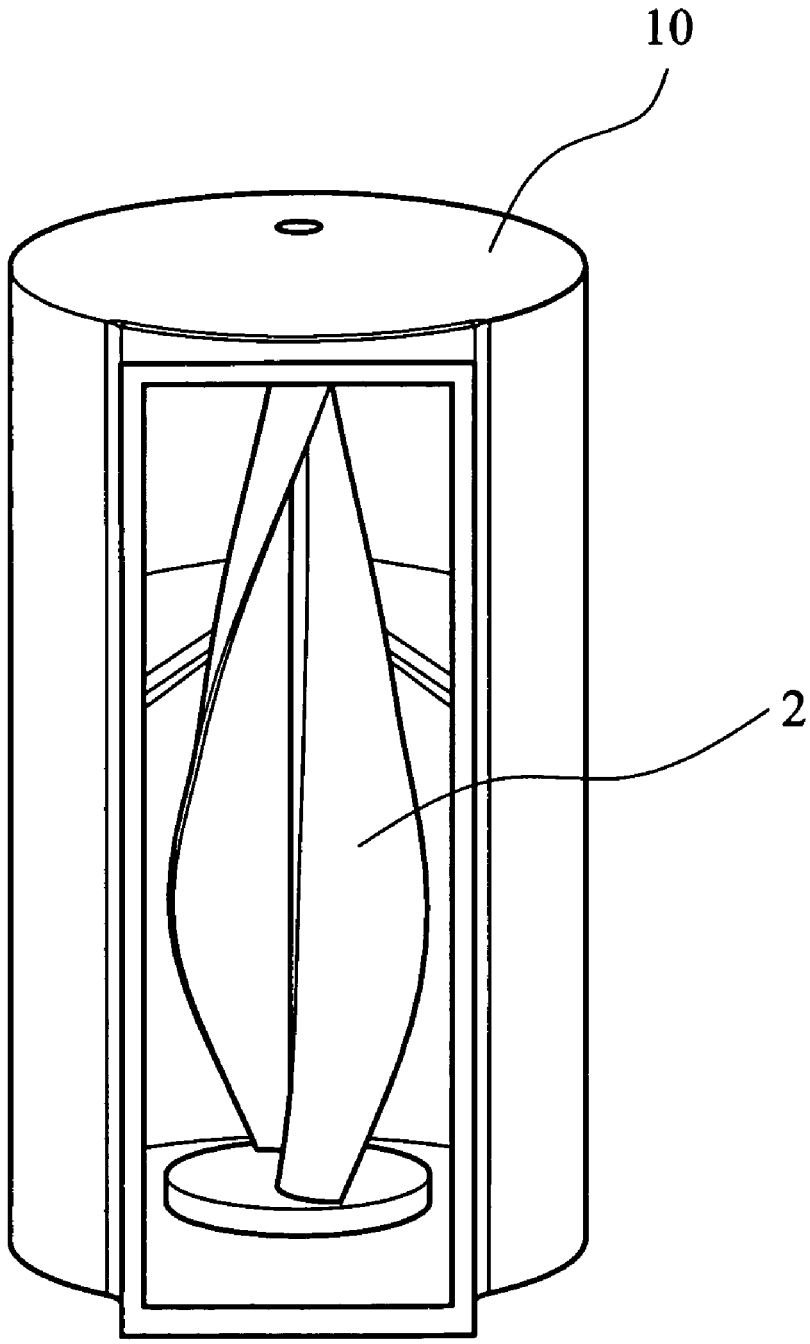
FIG. 3 is a front view of a cowling applied to a wind power generator of the invention.

Referring to FIGS. 1 to 3, a cowling 1 of the invention comprises a cover body 10 and an empennage 121 connected to the cover body 10 by the connecting parts 12. The cover body 10 comprises an accommodating space 101 and a first opening 103. The accommodating space 101 is communicated to the first opening 103. An impeller 2 for generating electric power is disposed in the accommodating space 101. The first opening 103 is located at one side of the cover body 10 and has an air inlet for transmission of the wind. The position of the connecting part 12 is located at the side of the cover body 10 opposite to the first opening 103. The empennage 121 can be adjusted by the wind so the first opening 103 faces the blowing wind. In this embodiment, the first opening 103 is a rectangle and the empennage 121 is a circle.

Figure 4:
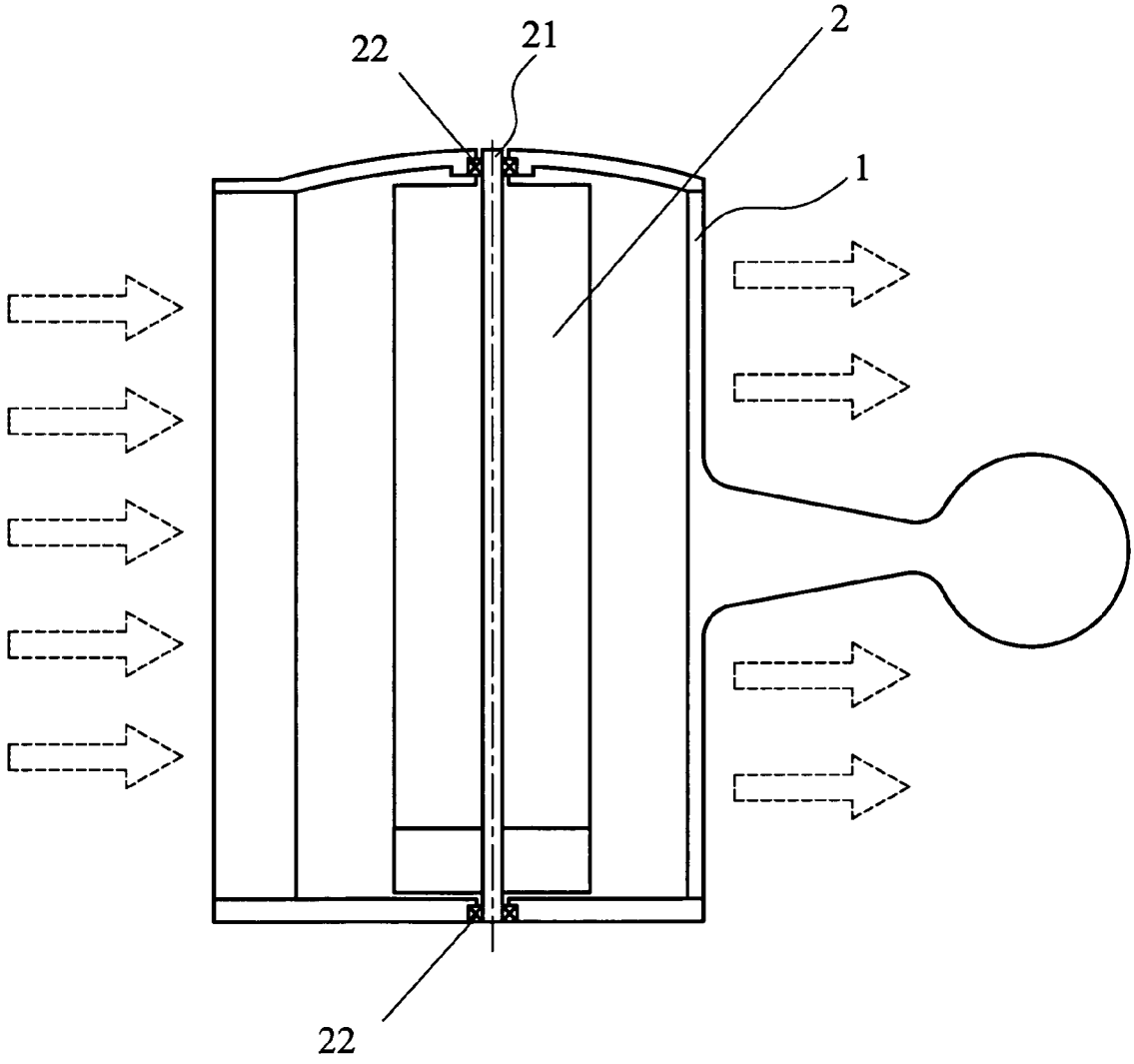
FIG. 4 is a cross-sectional view of the cowling shown in FIG. 3.

Referring to FIG. 4, in detail, the impeller 2 further comprises a shaft 21 passing through the center of the impeller 2. The cowling 1 is supported by the shaft 21 via two bearings 22, thus, when the impeller 2 rotates, the cowling 1 can simultaneously rotate without interference.

Figure 5:
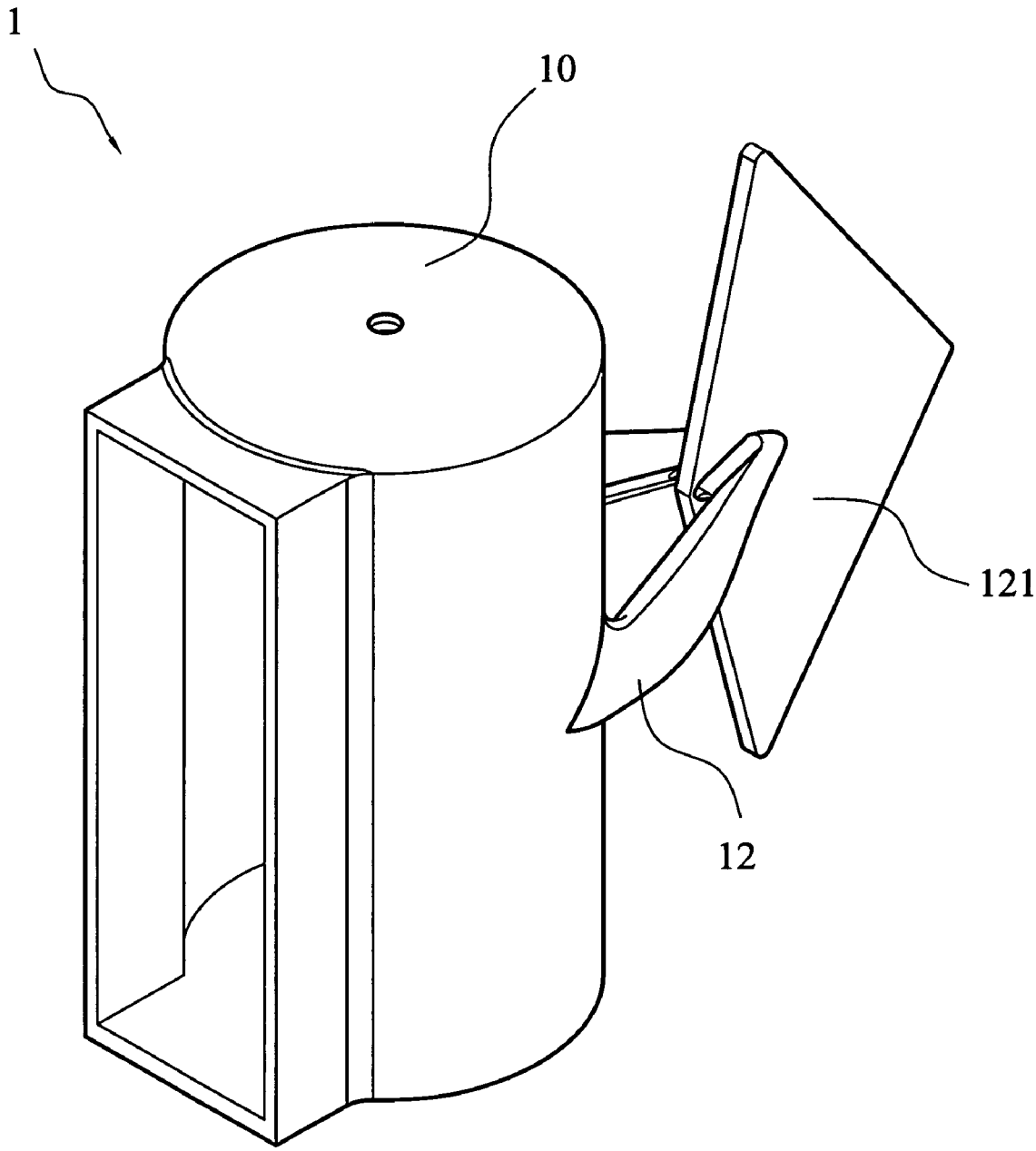
FIGS. 5 to 7 are schematic views to show all kinds of empennages.
Figure 6:
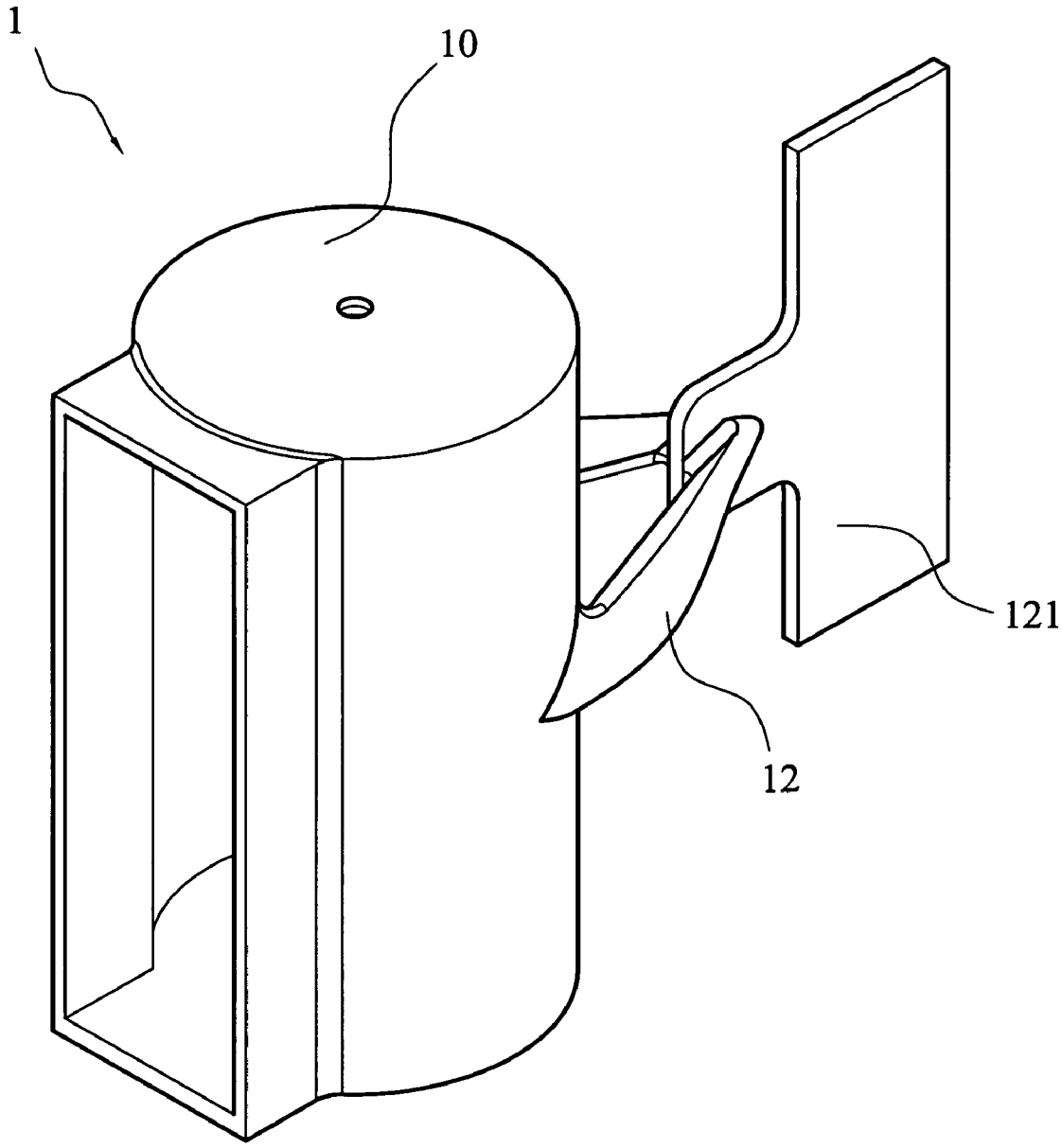
Figure 7:
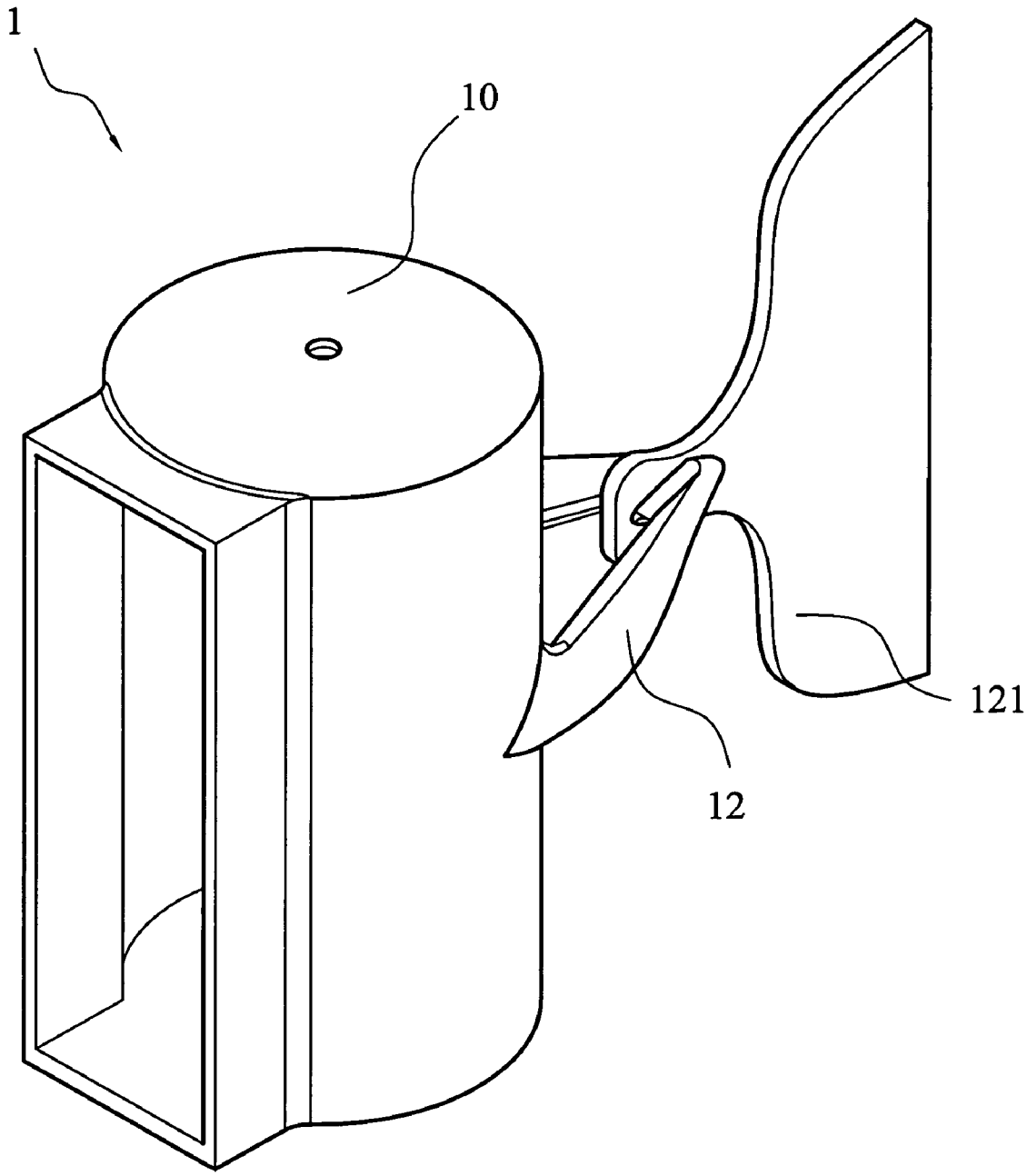

Note that shape of the empennage 121 is not limited. The empennage 121 may be rhombus, polygon, T-shape of fin shape shown in FIGS. 5 to 7. The empennage 121 can be any other shape enabling the cowling 1 to change direction.

The cover body 10 of the cowling 1 further comprises a second opening 105 shown in FIG. 2 opposite to the first opening 103. After the wind passes through the impeller 2, airflow exits from an air outlet, e.g. the second opening 105, to prevent interference between the wind and the airflow.

If the wind is multidirectional turbulence, the empennage 121 rotates along one direction of the multidirectional turbulence. Thus, the first opening 103 of the cowling 1 is adjusted to a stable position so that the first opening 103 faces the wind. One direction of the multidirectional turbulence can pass through the impeller 2 from the first opening 103 to drive the impeller 2. The cover body 10 blocks turbulent wind from other directions entering the cowling 1 and interfering with the impeller 2. Thus, the impeller 2 works efficiently and the lifespan of the impeller 2 is prolonged.

Figure 8:
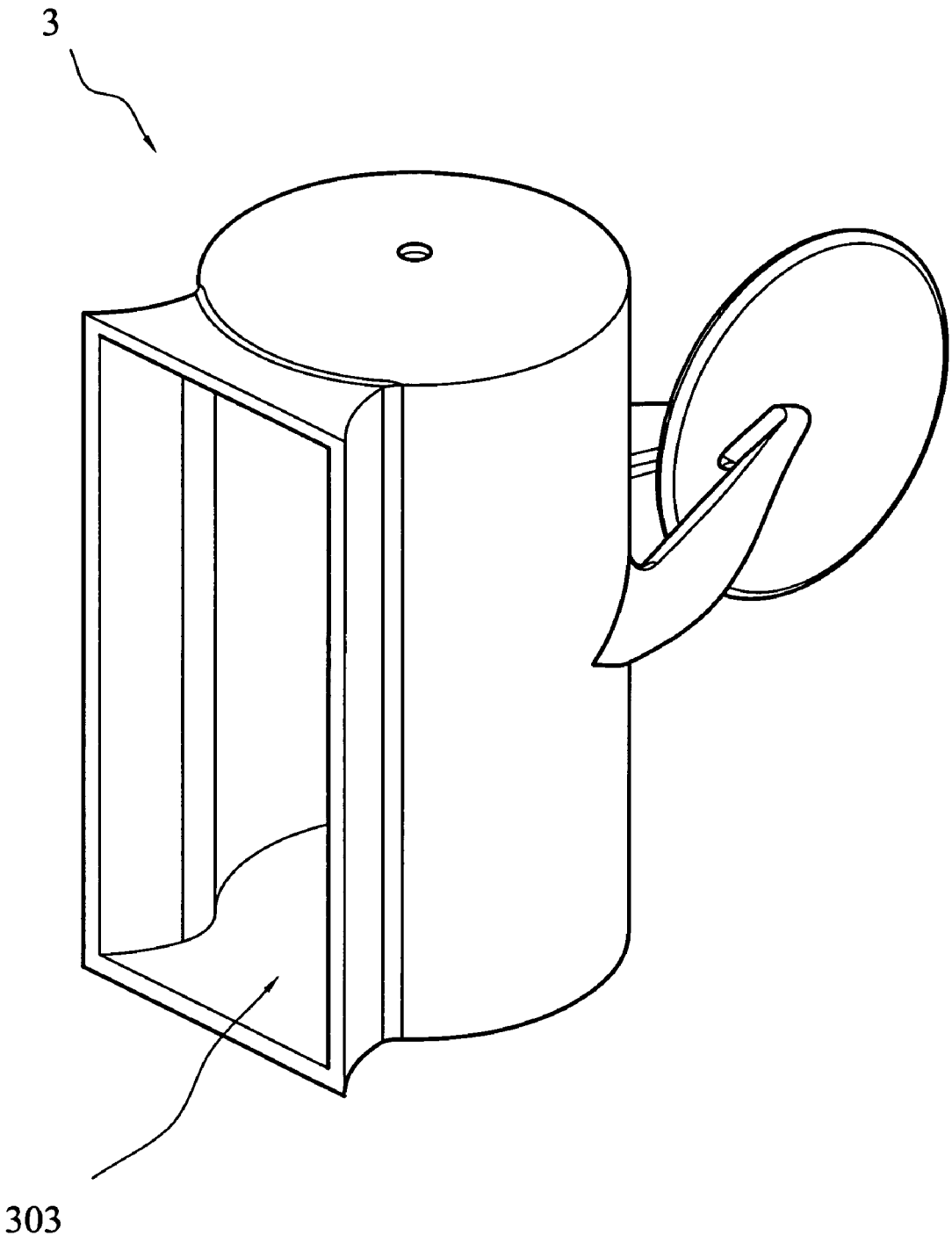
FIG. 8 is a schematic view of another embodiment of a cowling of the invention.

FIG. 8 shows another embodiment of the invention. Compared with FIG. 1, the first opening 303 of the cowling 3 is a bell shape for enlarging the area of the air inlet and concentrating the wind to drive the impeller.

Figure 9:
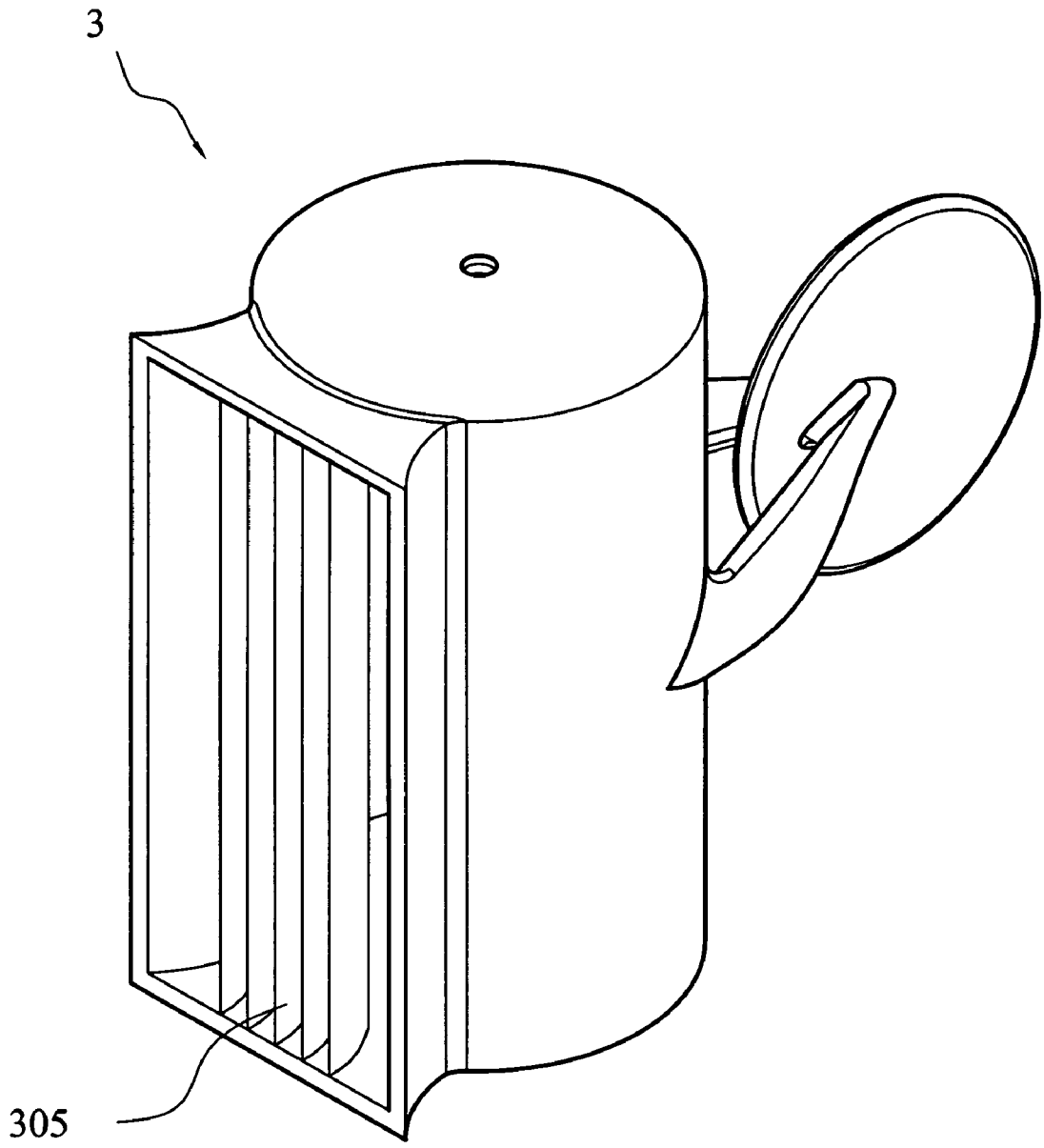
FIG. 9 is a schematic view of another embodiment of a cowling of the invention.

Referring to FIG. 9, the cowling 3 further comprises a plurality of air-guiding elements 305 installed in the first opening 303 shown in FIG. 8 for adjusting the wind. Thus, the impeller 2 works efficiently.

Figure 10:
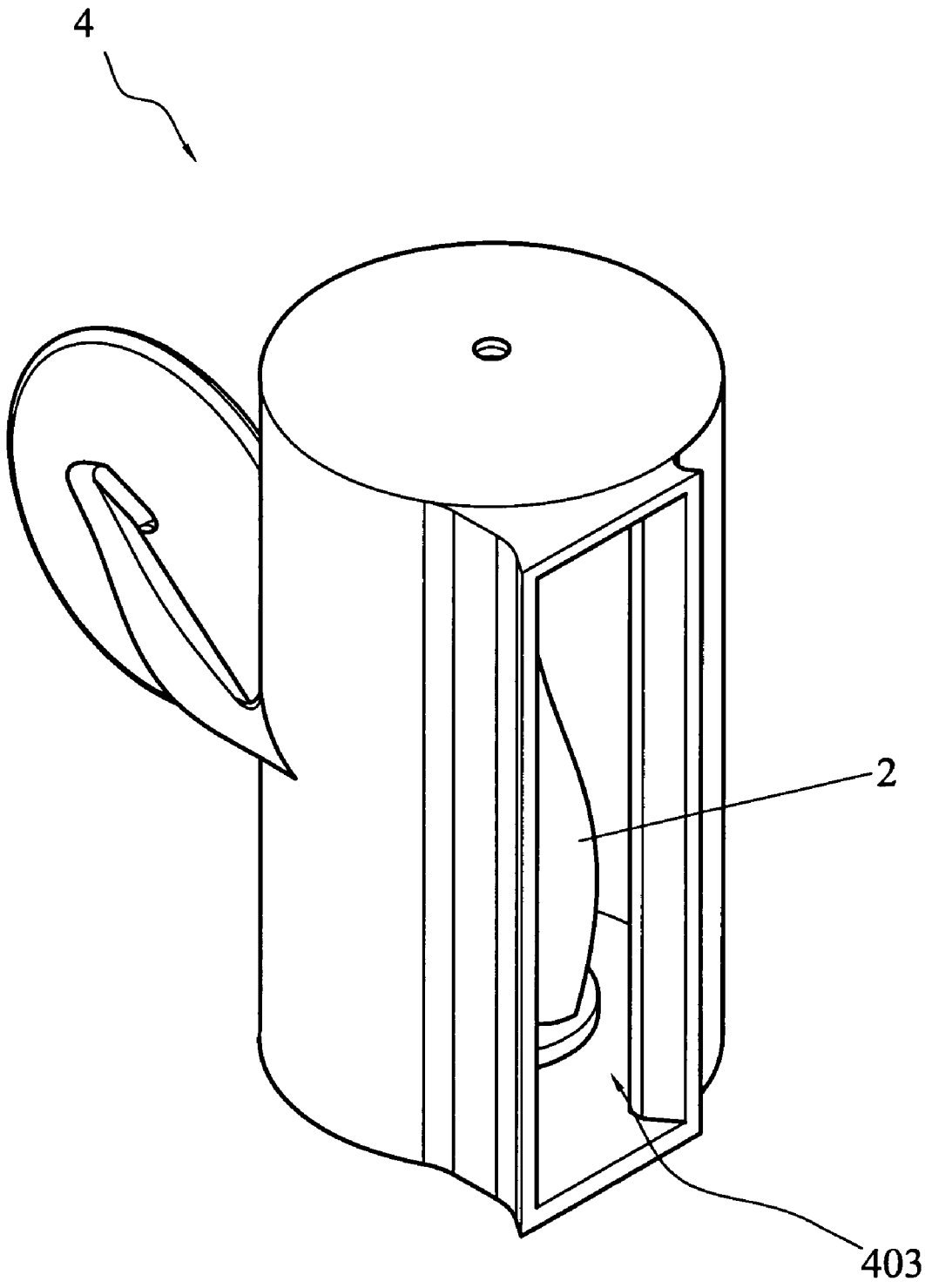
FIG. 10 is a schematic view to show a first opening of a cowling facing side of an impeller.
Figure 11:
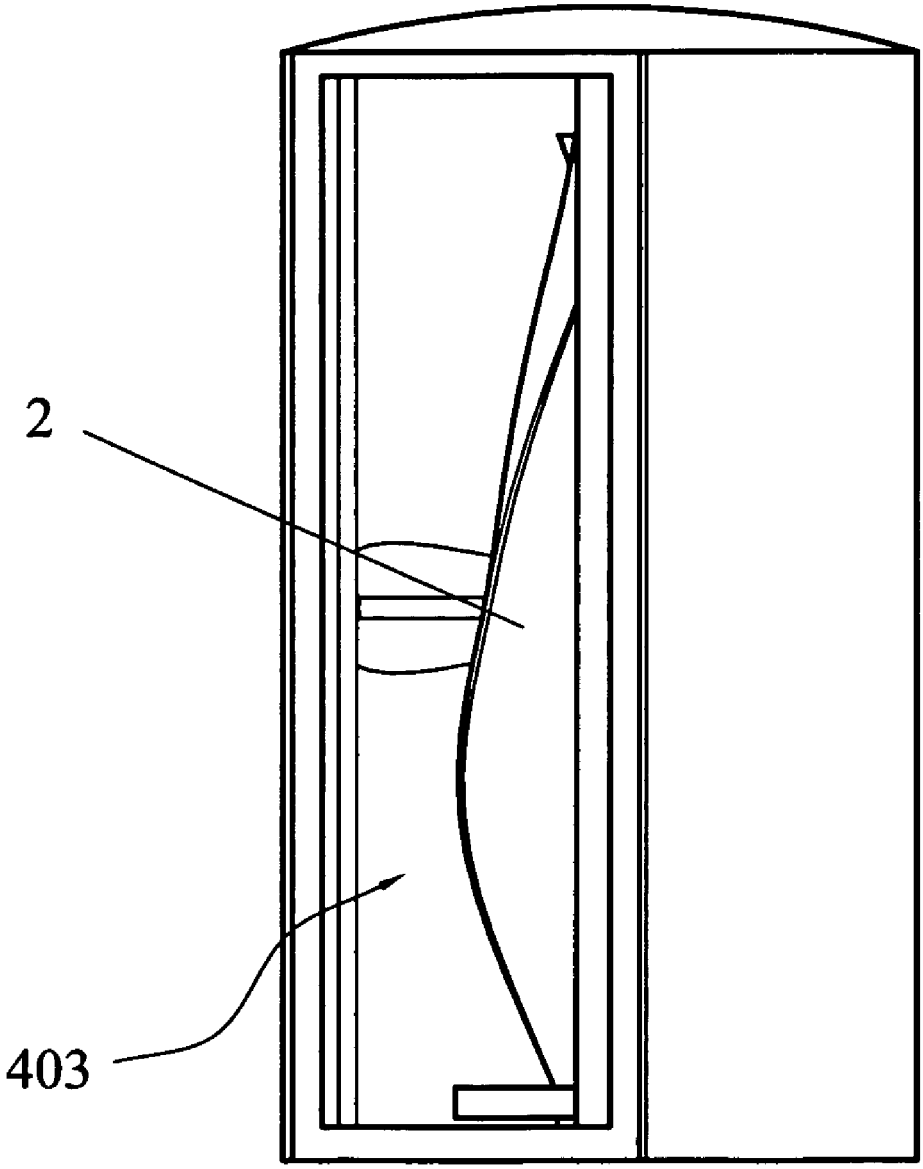
FIG. 11 is a front view the cowling shown in FIG. 10.

Moreover, the first openings can be located corresponding to one side of the impeller shown in FIGS. 10 to 11. Compared with FIG. 1, the first opening 403 of the cowling 4 does not correspondingly face the impeller 2, but faces the side of the impeller 2. In another word, the first opening 403 faces one side of the blades of the impeller 2. Thus, after entering the first opening, the wind directly drives the blades, thus increasing efficiency.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A cowling comprising:

a cover body having an accommodating space, a first opening communicated to the accommodating space, and a second opening communicated to the accommodating space and opposite to the first opening;

an impeller disposed in the accommodating space;

a shaft passing through the impeller and the cover body;

at least two connecting parts extended from the cover body; and an empennage connected to the cover body through the connecting parts and facing to the second opening, wherein the empennage is planar, and the empennage and the shaft are located on a same plane, wherein the first opening extends outwardly from the cover body and includes an outer peripheral surface, a plurality of air-guiding elements are installed within the first opening along a longitudinal direction of the cover body to divide the first opening into a plurality of air inlets, each of the plurality of air-guiding elements having an outer side surface and an inner side surface, and the outer peripheral surface of the first opening is flush with the outer side surfaces of the plurality of air-guiding elements, wherein the first opening asymmetrically faces one side of the impeller relative to the shaft.

2. The cowling as claimed in claim 1, wherein the connecting part comprises the empennage having a circle, rhombus, polygon, T, fin or other shape.

3. The cowling as claimed in claim 1, further comprising a bearing for supporting the shaft.

4. The cowling as claimed in claim 1, wherein the first opening is located at one side of the cover body and correspondingly faces the impeller.

5. The cowling as claimed in claim 1, wherein the first opening is an air inlet and the second opening is an air outlet.

6. The cowling as claimed in claim 1, wherein the first opening is a bell shape or a rectangle.

7. A cowling for a wind power generator, comprising:

a cover body having: a first opening; and a second opening;

an accommodating space communicated to the first opening and the second opening;

an impeller disposed in the accommodating space;

a shaft passing through the impeller and the cover body; and an empennage connected to the cover body by at least two connecting parts, wherein the second opening communicated to the accommodating space and opposite to the first opening; and wherein the empennage is kept out of the second opening, the empennage is planar, and the empennage and the shaft are located on a same plane, and wherein the first opening extends outwardly from the cover body and includes an outer peripheral surface, a plurality of air-guiding elements are installed within the first opening along a longitudinal direction of the cover body to divide the first opening into a plurality of air inlets, each of the plurality of air-guiding elements having an outer side surface and an inner side surface, and the outer peripheral surface of the first opening is flush with the outer side surfaces of the plurality of air-guiding elements, wherein the first opening asymmetrically faces one side of the impeller relative to the shaft.

8. The cowling as claimed in claim 7, wherein the connecting part comprises an empennage having a circle shape, rhombus shape, polygon shape, T shape, fin shape or other shapes.

9. The cowling as claimed in claim 7, further comprising a bearing for supporting the shaft.

10. The cowling as claimed in claim 7, wherein the first opening is a bell shape or a rectangle.

11. The cowling as claimed in claim 7, wherein the first opening is an air inlet and the second opening is an air outlet.

12. A cowling comprising:

a cover body having an accommodating space;

an impeller disposed in the accommodating space;

a shaft passing through the impeller and the cover body;

two bearings disposed at the two ends of the shaft, respectively;

two openings communicated to the accommodating space and disposed opposite each other; and an empennage connected to the cover body by at least two connecting parts and kept out of one of the two openings, wherein the empennage is planar, and the empennage and the shaft are located on a same plane, wherein the other one of the two openings extends outwardly from the cover body and includes an outer peripheral surface, a plurality of air-guiding elements are installed within the other one of the two openings along a longitudinal direction of the cover body to divide the other one of the two openings into a plurality of air inlets, each of a plurality of air-guiding elements having an outer side surface and an inner side surface, and the outer peripheral surface of the other one of the two openings is flush with the outer side surfaces of the plurality of air-guiding elements, wherein the first opening asymmetrically faces one side of the impeller relative to the shaft.

* * * * *